United States Patent [19]

Robson

[11] Patent Number: 4,922,586

[45] Date of Patent: May 8, 1990

[54] SLIDE-TYPE FASTENER

[76] Inventor: Peter M. . Robson, Les Anguettes, Clos du Port, La Rocque, Grouville, Jersey, Channel Islands

[21] Appl. No.: 229,728

[22] Filed: Aug. 2, 1988

Related U.S. Application Data

[63] Continuation of Ser. No. 919,713, Oct. 16, 1986, abandoned.

[30] Foreign Application Priority Data

Oct. 17, 1985 [GB] United Kingdom ..... 8525587
Jul. 23, 1986 [GB] United Kingdom ..... 8618014

[51] Int. Cl.[5] ..... A44B 19/16

[52] U.S. Cl. ..... 24/399; 24/389; 24/576; 24/587; 24/589

[58] Field of Search ..... 24/589, 230.5 AD, 241 R, 24/31 V, 437, 389, 399, 432, 576, 587, 588

[56] References Cited

U.S. PATENT DOCUMENTS

| | | | |
|---|---|---|---|
| 147,078 | 2/1874 | Stone | 24/589 |
| 2,422,249 | 6/1947 | Malluk | 24/389 X |
| 2,658,250 | 11/1953 | Koutnik | 24/399 |
| 3,350,752 | 11/1967 | Plummer | 24/576 |
| 3,790,993 | 2/1974 | Gilles et al. | 24/399 |
| 3,858,282 | 1/1975 | Plummer | 24/576 |

FOREIGN PATENT DOCUMENTS

| | | | |
|---|---|---|---|
| 1153027 | 2/1958 | France | 24/587 |
| 424201 | 6/1948 | Italy | 24/389 |
| 497015 | 8/1954 | Italy | 24/399 |
| 523995 | 7/1957 | Italy | 24/399 |
| 8516 | 3/1894 | Switzerland | 24/589 |
| 593646 | 12/1977 | Switzerland | 24/399 |

*Primary Examiner*—Laurie K. Cranmer
*Attorney, Agent, or Firm*—Oblon, Spivak, McClelland, Maier & Neustadt

[57] ABSTRACT

A slide-type fastener which has mating halves of which one has an elongate, lengthwise-extending bead and the other has a laterally open elongate, lengythwise-extending recess is adapted to receive said bead, the fastener is capable of interengagement such that the bead is introduced laterally into and removed laterally from the recess and is adapted so that when the bead is in the recess, applying lateral tension between the said two halves applies no uncountered force which removes the bead from the recess.

8 Claims, 4 Drawing Sheets

SLIDE-TYPE FASTENER

This application is a continuation of application Ser. No. 06/919,713, filed on Oct. 16, 1986, now abandoned.

BACKGROUND TO THE INVENTION

This invention relates to slide-type fasteners.

An interesting account by Lewis Weiner of the development of slide fasteners from their invention by Elias Howe in 19851 is to be found in "Scientific American", June 1983, pp. 122–129.

Among the fasteners made by techniques described by Mr Weiner are heavy duty, weatherproof fasteners for harsh environment clothing. Since, however, they consist of individual teeth carried on tapes (stringers) joined side by side, with the teeth intermeshing, by a slide, weatherproofing is problematical. It is a matter of effectively sealing, as by rubberising, the gaps between the teeth as best as one can. No completely satisfactory method of doing this has been found, and the usual resort, for weatherproofing, is to have a flap which covers the fastener and which is secured by a Velcro (RTM) type fastener.

Another problem with such fasteners is their tendency to jam by teeth becoming displaced or by intrusion of a thread from the garment or a frayed stringer.

One other type of slide fastener not mentioned in Mr Weiner's account comprises intermeshing elongate beads and recesses formed in a polyvinyl chloride or other plastics material film. Such a slide fastener is not extensively used, being mainly found on document wallets and pouches where it is moulded integrally. Various attempts to improve upon this type of continuous head fastener are mentioned in the patent literature, including German Patent Publication 2341452, 2656045 and 2701590 which involve various complicated profiles intended to effect clamping or tongue-and-groove like actions. They all evidently suffer from the disadvantage that the very flexibility that permits the two halves to be engaged also enables the halves to deform under tension forces therebetween so that they can disengage in ordinary use.

For clothing and most other applications fasteners comprised of individual teeth mounted on tapes or metal or plastic wire-formed teeth woven or otherwise embodied into tapes are preferred on account of their positive engagement when fastened.

The present invention provides an improved slide fastener of this continuous bead type not subject to the problems aforementioned.

SUMMARY OF THE INVENTION

The invention comprises a slide-type fastener having mating halves of which one has an elongate, lengthwise-extending bead and the other has a laterally open elongate, lengthwise-extending recess adapted to receive said bead, the fastener being capable of interengagement such that the bead can be introduced laterally into and removed laterally from the recess and being adapted so that when the bead is in the recess, applying lateral tension between the said two halves applies no uncountered force which tends to remove the head from the recess.

Applying such lateral tension may apply forces opposite to those required to effect such interengagement aforesaid.

Extractor means may be provided for extracting said bead laterally from said recess. Said extractor means may comprise a slide of the kind familiar from conventional slide fasteners, which may also serve—or will in most cases also serve—for fastening as well as unfastening the fastener. It may be desired, however, in some embodiments, to have a permanent or semi-permanent fastening. Certain types of fasteners according to the invention may be useful in constructional and civil and mechanical engineering applications as a method for joining together panels, or joining panels to supporting members for example. If the fastener is so constructed as by being sufficiently flexible to lock on being merely pushed together, so that a slide is unnecessary for locking, and if such panels or other members are intended to be permanently locked together, then the slider can be dispensed with. A semi-permanent arrangement can be provided in which a slider is associated with the fastener but not necessarily retained therewith. Such a slider can be adapted as a key, and the slider or a part thereof adapted as a co-operating lock, as by the slider having a notched profile and one or both ends of the flexible members having a complementarily profiled opening for insertion of the slider.

Said bead and said recess may be similar so that said bead bounds a recess in the said one half that is adapted to receive a like bead which itself bounds the said recess in the other half. Said halves may be similar so that they may be made from a single extrusion.

In another arrangement, the invention comprises a slide-type fastener having mating halves of which one has an elongate, lengthwise-extending bead and the other has a laterally open, elongate, lengthwise-extending recess adapted to receive said bead, the said halves being capable of interengagement such that the bead can be introduced laterally into and removed laterally from the recess, the recess being bounded by a latch member for latching the bead into the recess said latch member being biassed into latching relationship and being swingable against the bias substantially out of such latching relationship for mating and separating the two halves, the halves having further abutting surfaces held together by the bead being latched in the recess.

Two beads and two recesses may be symmetrically disposed either side of common such further abutting surfaces so that said halves are similar so that they may again be made from a single extrusion.

The fastener may comprise lever means with said latch member adapted to be engaged by cam means of a fastener slide for swinging said latch member.

Said latch member may be an integral part of said half and be swingable by elastic bending thereof about a pivot point in the said half.

The fastener may comprise flexible flaps and cooperating bead and recess fastening therefor by which the flaps can be fastened over sewing holes.

BRIEF DESCRIPTION OF THE DRAWINGS

Embodiments of slide-type fasteners according to the invention will now be described with reference to the accompanying drawings, in which.

DETAILED DESCRIPTION OF THE PREFERRED EMBODIMENTS

The drawings illustrate slide-type fasteners 11 having mating halves 11*a*, 11*b*. In each case the halves 11*a*, 11*b* are similar so that they can be made of the same extruded section, for example. For the moment, however, for ease of understanding the principles of construction, they will be described as if they were not necessarily similar.

In each case, one half, 11*a*, has an elongate, lengthwise-extending bead 12 and the other has a laterally open, elongate, lengthwise extending recess 13 with at least one wall portion 12*a* adapted to receive said bead 12. The fasteners are adapted for interengagement such that the bead 12 can be introduced laterally into and removed laterally from the recess 13. By this is meant that the two halves 11*a*, 11*b* can be mated and separated while remaining side-by-side in the manner of a regular slide fastener, without having to slide the one lengthwise into or out of the other to engage or disengage the bead 12 and recess 13.

The fasteners are further adapted so that when the bead 12 is in the recess 13, applying lateral tension (i.e. in the directions of arrows 10) between the two halves 11*a*, 11*b* applies no encountered force which tends to remove the bead 12 from the recess 13. Forces are in fact applied between the bead 12 and the wall 13*a* forming recess 13 opposite to those required to effect such interengagement aforesaid.

The effect of this is, of course, that the fastener cannot become undone under the sort of tension forces to which it will be subjected in ordinary use. Previous attempts to make continuous bead type slide fasteners have suffered from the disadvantage that tension forces between the two halves can effect deformation permitting them to separate. Of course, excessive tension forces, above what can normally be anticipated, may break or cause deformation of various parts of the fasteners even of the present invention and such excessive forces must be discounted in looking at the performance of the present invention as compared with the prior art.

Figure 1:
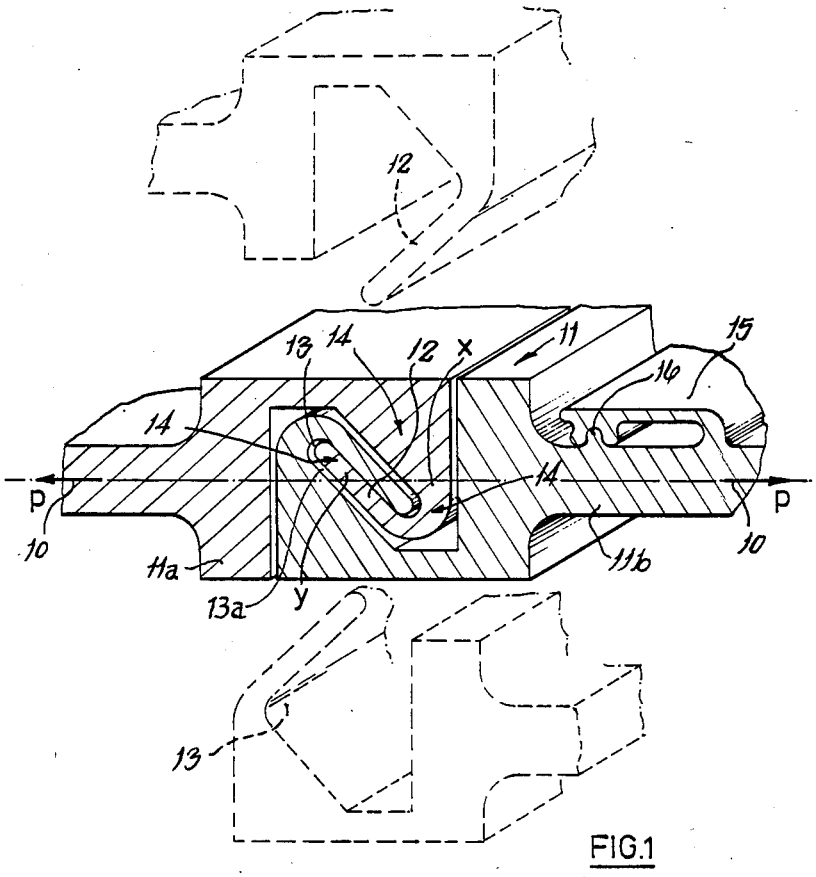
FIG. 1 is a perspective view showing the cross-section of a first embodiment and showing in full line the two halves mated together and in broken line the two halves immediately prior to coming together (or immediately after separation)

The two halves 11*a*, 11*b* in the embodiment illustrated in FIG. 1 have, when the bead 12 is in the recess 13, a common principal plane P—P (i.e. the plane of one of the halves 11a being an extension of the plane of the second half 11b so as to constitute the common principal plane), the bead 12 comprising the free end of a hook-like formation 14, viewed in cross-section, which hook-like formation 14 twice crosses the principal plane P—P, once at X and again at Y. The bead 12 and—in this case, the two halves 11*a*, 11*b* being symmetrical—are flexible, and capable of deformation such that the bead 12 can be introduced laterally into the recess 13. The position of maximum such deformation is shown in broken line in FIG. 1, in which the bead 12 and the recess 13 are both opened out so that the one can be introduced into the other simply by moving the two halves 11*a*, 11*b* towards one another.

Figure 2:
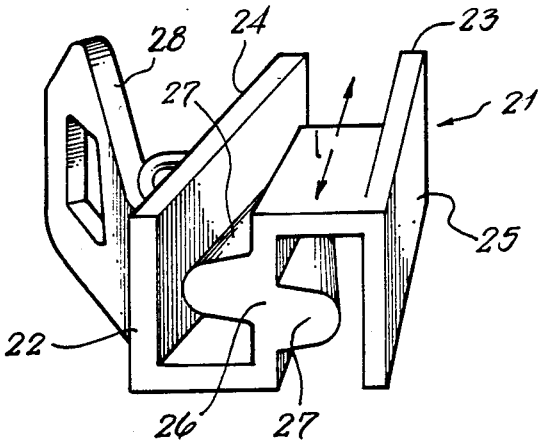
FIG. 2 is a perspective view of a slider suitable for use with the fastener illustrated in FIG. 1.

Such movement, as well as the reverse movement for separation of the two halves, is effected by a slider 21 as shown in FIG. 2, which has a wide end 22 and a narrow end 23, the wide end 22 being that at which the two halves 11*a*, 11*b* are separate, and the narrow end 23 being that at which the two halves are interengaged with the bead 12 in the recess 13. The slider has front and rear faces 24, 25 respectively which are connected together at the wide end 23 and over a part, for example about half the length "1" of the slider 21, by a bridge 26 which has cam members 27 for opening out the bead and recess 12, 23 of the two halves of the fastener 11. The slider 21 has the usual hinged tag 28 for manipulating it along the fastener 11—actually, because of the symmetrical arrangement, a tag might with advantage be put on both sides.

It will be seen that deformation of the bead 12 and recess 13 can only be effected by the slider 21—tension forces in the direction of the arrows in FIG. 1 will urge the deformable parts—namely the bead 12 and recess 13—into ever closer and tighter engagement, and will militate against any tendency of the two halves 11*a*, 11*b* to "roll out" as will be the case with conventional such elongate bead type fasteners.

Moreover, the arrangement also forms a watertight/airtight arrangement—always provided manufacturing tolerances are appropriate—which is reinforced by normal usage tensions between the two halves 11*a*, 11*b*, unlike conventional toothed slide-type fasteners, which require special proofing techniques.

Additional proofing can be had by the provision of flexible flaps 15 which can be bent back and snapped on to beads 16 to cover up any sewing holes.

Figure 3:
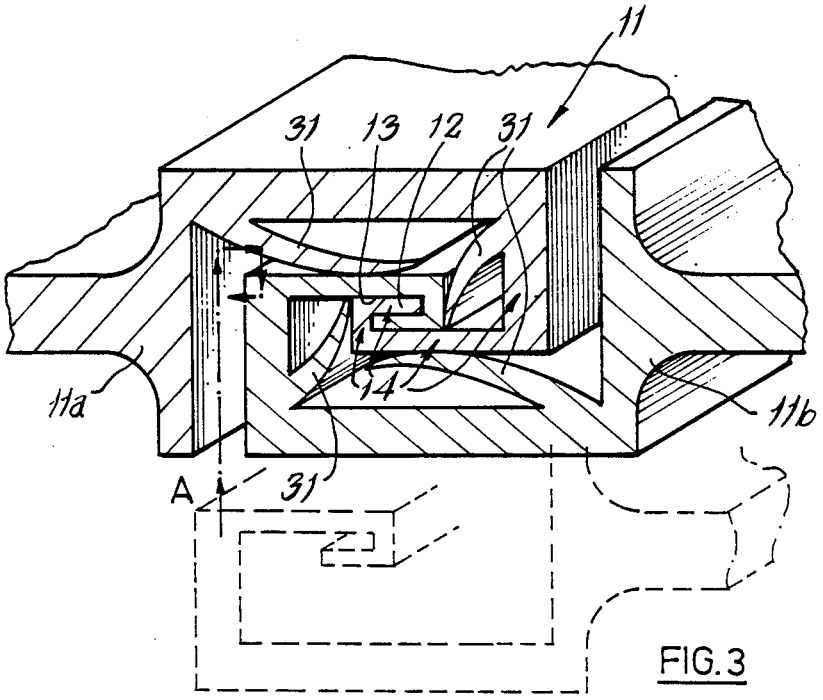
FIG. 3 is a view like FIG. 1 of a second embodiment.
Figure 4:
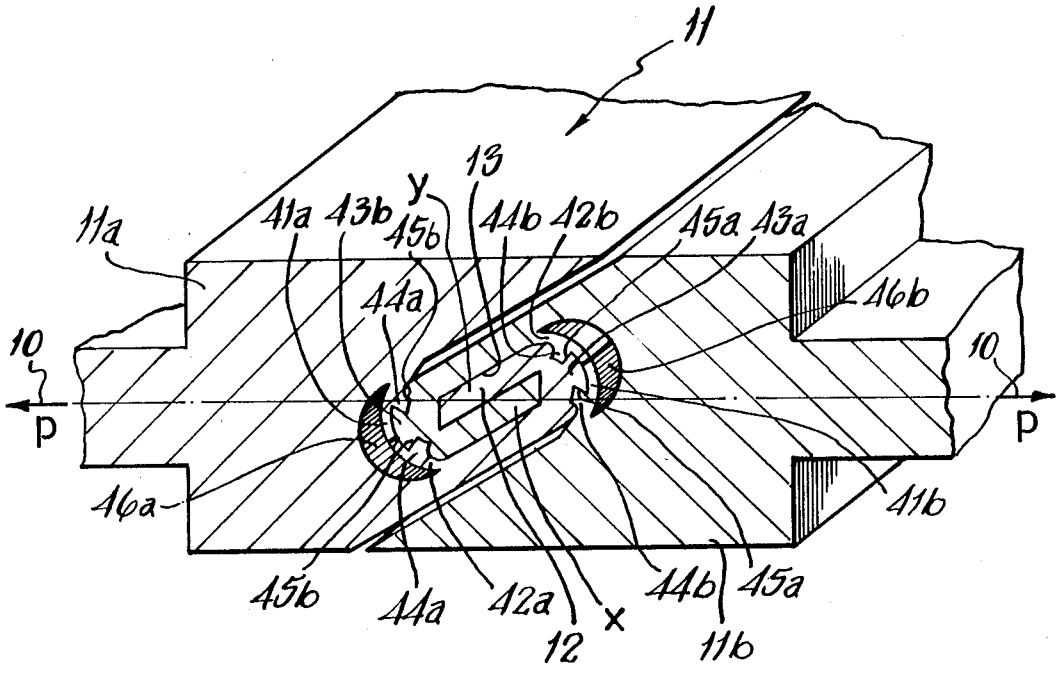
FIG. 4 is a view like FIG. 1 of a third embodiment.

FIG. 3 illustrates another embodiment of fastener 11 according to the invention, in which the bead 12 and recess 13, in fact the entire hook 14, are rigid. Interengagement is by way of starting from a position as shown in broken line and moving as indicated by the compound arrow "A". Resilient spring members 31 (which can be extruded integrally with the rest of the section in plastics material for example polyester or polyamide) are pushed back by such movement but spring out to the position illustrated in full line to hold the two halves 11*a*, 11*b* in interengagement.

It will be seen that tension forces between the two halves 11*a*, 11*b* cannot disengage them, since the hook parts 14 are essentially rigid and are held together by spring forces from the members 31, which are not affected at all by the tension forces.

Such an arrangement—depending entirely on the degree of rigidity of the hook parts 14, everything of course being relative—may not need or even admit of the use of a slider. The fastener could, however, be engaged and released by a compound movement according to arrow A however effected. This arrangement might well be suitable for fastening together rigid plates or panels which might themselves be of a synthetic material so that the fastener halves 11*a*, 11*b* might be formed in them by for example running a profiling tool down an edge.

The spring members 31 are of course not necessary if the fastener is not required to be unfastened once fastened. The arrangement could be wedged or filled with a sealant to form a permanent connection.

The embodiment illustrated in FIG. 3 has a different locking arrangement designed to help maintain the fastener closed under forces other than in the direction of arrows acting in the principal plane P—P.

Flexible flap members 41*b*, 42*b* on half 11*b* surround the "blunt" end 43*a* of the hook part 14 of half 11*a* and have locking ribs 44*b* which engage in correspondingly profiled grooves 45*a* of half 11*a* in the blunt end 43*a* aforesaid thereof. The flap members 41*b*, 42*b* can flex on deformation by the slider to open or close the fastener into a void 46*b* in the half 11*b*.

Since the halves 11*a*, 11*b* are symmetrical, there are corresponding flaps 41*a*, 42*a* on half 11*a* with locking ribs 44*a* engaging in grooves 45*b* in the blunt end 43*b* of the hook part 14 of half 11*b*.

As before, it is the bead and recess arrangement 12, 13 that tends to resist separating deformation under principal plane P—P forces. The engagement of the ribs 44*a*, 44*b* in the grooves 45*b*, 45*a* respectively tends to hold the main bead/recess arrangement 12, 13 together even under the action of bending and shear forces perpendicular to the principal plane P—P. Moreover, they reinforce the sealing action by providing additional sealing regions which tend to come together even more tightly on deformation—other, or course, than on deformation occasioned by the passage of the slider.

Figure 5:
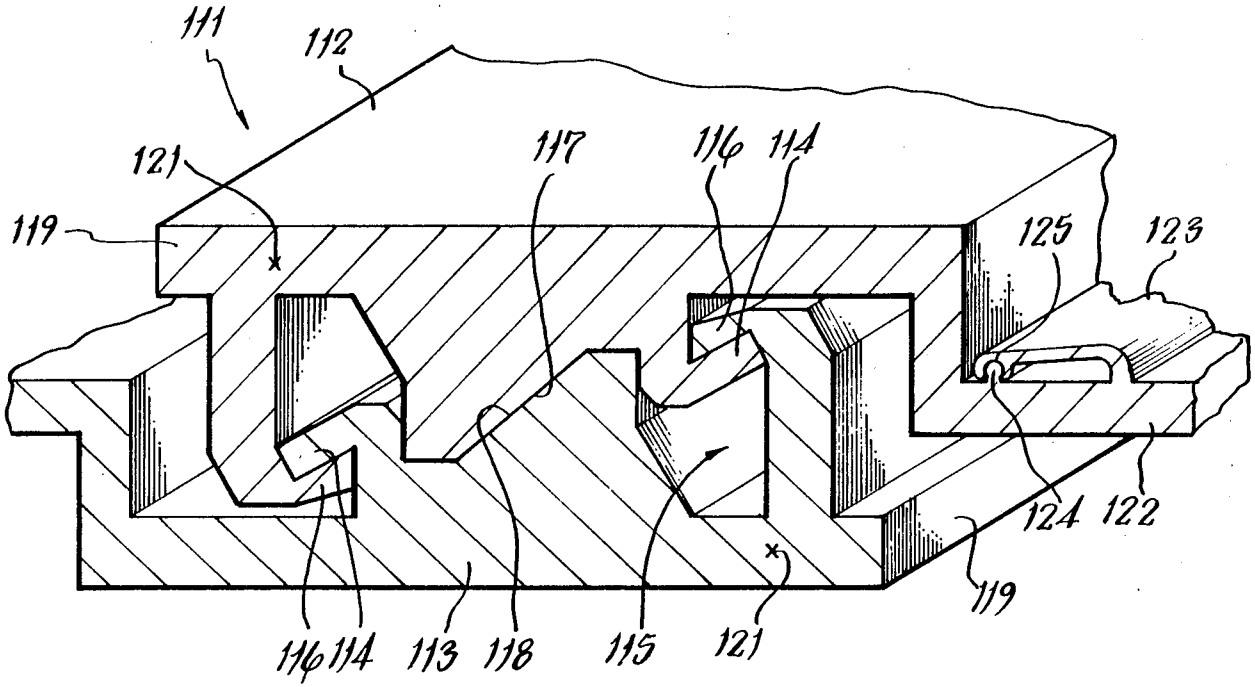
FIG. 5 is a perspective view showing the cross-section of a fourth embodiment.

FIG. 5 illustrates a slide-type fastener 11 having mating halves 112, 113 of which one has an elongate, lengthwise-extending bead 114 and the other has a laterally open, elongate, lengthwise-extending recess 115 adapted to receive said bead 114, the said halves 112, 113 being capable of interengagement such that the bead 114 can be partially introduced laterally into and removed laterally from the recess 115, the recess 115 being bounded by a latch member 116 for latching the bead 14 into the recess 115 said latch member 116 being biassed into latching relationship and being swingable against the bias and without deforming the recess 115 out of such latching relationship for mating and separating the two halves 112, 113, the two halves having further abutting surfaces 117, 118 held together by the bead 114 being latched in the recess 115.

The fastener 111 comprises two beads 114 and two recesses symmetrically disposed on either side of the abutting surfaces 117, 118 so that said halves 112, 113 are similar so that they may be made from a single extrusion.

The fastener 111 comprises lever means 119 with said latch member 116 adapted to be engaged by cam means of a fastener slide for swinging said latch member 116.

The action of the slide is to bend said lever means 119 in the direction shown by the arrows thereby.

Said latch member 116 is an integral part of said half and is swingable by elastic bending about a pivot axis 121 in the said half.

The fastener 111 has edge portions 122 by which it can be sewn to parts of a garment or other article. On the edges 122 are flexible flaps 123 and cooperating bead 124 and recess 125 fastening therefor by which the flaps 123 can be fastened over sewing holes in the edges 122.

The fastener 111 can be made of any suitable material including synthetic plastics materials and metals.

Additional sealing and interlocking to make a more impermeable fastening may be effected by a labyrinth arrangement 128 intermediate the abutting surfaces 117, 118.

As mentioned previously the embodiments are symmetrical, and this is clearly advantageous from the point of view of economy of manufacture and use, though it is not necessary and advantages for special applications might be had from an asymmetric arrangement.

What we claim is:

1. A slide-type fastener having first and second mating halves of which one has an elongate lengthwise-extending bead and the other has at least one wall portion forming a laterally open elongate, lengthwise extending recess adapted to receive said bead, the fastener being capable of interengagement such that the bead is introduced laterally into and removed laterally from the recess, wherein said first and second halves lie in a first and second plane and wherein said first and second planes constitute a common principal plane, the bead comprising the free end of a hook-like formation, viewed in cross-section, wherein opposed surfaces of said hook-like formation twice cross said common principal plane so as to form means for applying lateral tension between said first and second halves for urging the bead and the at least one wall portion into closer and tighter engagement and militating against any tendency of the first and second halves to roll out of interengagement by deformation due to such lateral tension wherein said recess and said bead are rigid and said first and second halves are adapted for resilient deformation otherwise than at said bead and said recess which are urged mutually together by resilience and wherein said bead comprises a hook-like formation having a point which can form said other half so that the point of the hook-like formation clears the opening of the recess and can be moved into alignment with the recess at right angles to the direction in which lateral tension forces are applied, and is then urged into the recess by said resilience.

2. A slide-type fastener having first and second mating halves of which one has an elongate lengthwise-extending bead and the other has at least one wall portion forming a laterally open elongate, lengthwise extending recess adapted to receive said bead, the fastener being capable of interengagement such that the bead is introduced laterally into and removed laterally from the recess, wherein a web portion of said first and second halves lie in a first and second plane and wherein said first and second planes constitute a common principal plane, the bead comprising the free end of a hook-like formation, viewed in cross-section, wherein opposed surfaces of said hook-like formation cross said common principal plane at least three times so as to form means for applying lateral tension between said first and second halves for urging the bead and the at least one wall portion recess into closer and tighter engagement and militating against any tendency of the first and second halves to roll out of interengagement by deformation due to such lateral tension.

3. A fastener according to claim 2, in which applying lateral tension between the said two halves applies forces between the bead and the recess opposite to those required to effect such interengagement aforesaid.

4. A fastener according to claim 2, in which extractor means are provided for extracting said bead laterally from said recess.

5. A fastener according to claim 2, in which said bead and said recess are similar to so that said bead bounds a recess in the said one half that is adapted to receive a like bead which itself bounds the said recess of the other half.

6. A fastener according to claim 5, said halves being similar to that they may be made from a single extrusion.

7. A fastener according to claim 2, in which the said recess and/or the said bead are flexible, and capable of deformation such that the bead can be introduced laterally into the recess.

8. A fastener according to claim 2, in which said recess and said bead are rigid and said halves are capable of resilient deformation otherwise than at said bead and said recess which are urged mutually together by the resilience.

* * * * *

UNITED STATES PATENT AND TRADEMARK OFFICE

CERTIFICATE OF CORRECTION

PATENT NO. : 4,922,586

DATED : MAY 8, 1990

INVENTOR(S) : PETER M. ROBSON ET AL.

It is certified that error appears in the above-identified patent and that said Letters Patent is hereby corrected as shown below:

ON TITLE PAGE: Item [76]

In the inventors, please insert the second inventors name and address --John H. Keighley, Harrogate, Yorkshire, England--.

Signed and Sealed this

Seventeenth Day of December, 1991

*Attest:*

*Attesting Officer*

HARRY F. MANBECK, JR.

*Commissioner of Patents and Trademarks*